US006054962A

United States Patent [19]

Ha et al.

[11] Patent Number: 6,054,962

[45] Date of Patent: Apr. 25, 2000

[54] DUAL BAND ANTENNA

[75] Inventors: Dong-In Ha, Seoul; Ho-Soo Seo, Icheon; Alexandre Goudelev; Konstantin Krylov, both of Suwon, all of Rep. of Korea

[73] Assignee: Samsung Electronics Co. Ltd., Rep. of Korea

[21] Appl. No.: 08/967,667

[22] Filed: Nov. 10, 1997

[30] Foreign Application Priority Data

Jul. 19, 1997 [KR] Rep. of Korea ..... 97-33877

[51] Int. Cl.[7] ..... H01Q 1/00

[52] U.S. Cl. ..... 343/722; 343/702; 343/715; 343/790

[58] Field of Search ..... 343/702, 715, 343/790, 791, 792, 722

[56] References Cited

U.S. PATENT DOCUMENTS

| | | | |
|---|---|---|---|
| 4,675,687 | 6/1987 | Elliott | 343/715 |
| 5,017,935 | 5/1991 | Hayashi et al. | 343/715 |
| 5,617,105 | 4/1997 | Tsunekawa et al. | 343/702 |
| 5,734,352 | 3/1998 | Seward et al. | 343/722 |
| 5,898,406 | 4/1999 | Matero | 343/702 |

FOREIGN PATENT DOCUMENTS

| | | | |
|---|---|---|---|
| 84//0261 | 7/1984 | WIPO | H01Q 9/16 |

*Primary Examiner*—Hoanganh Le
*Assistant Examiner*—Shih-Chao Chen
*Attorney, Agent, or Firm*—Dilworth & Barrese

[57] ABSTRACT

A dual band antenna with a simple and compact structure includes an inductor, first and second rod-like radiating elements connected to opposite ends of the inductor, with dielectric material surrounding both the inductor and the joining portions of the first and second radiating elements on the respective ends of the inductor. A conductive housing surrounds the dielectric and supports the inductor and the joining portions of the first and second radiating elements. The housing and dielectric create a capacitance, so that an LC resonant circuit is formed in conjunction with the inductor. The LC circuit is designed such that only one radiating element radiates at the higher band of the dual operating band, whereas both radiating elements radiate at the lower band.

15 Claims, 5 Drawing Sheets

DUAL BAND ANTENNA

BACKGROUND OF THE INVENTION

1. Field of the Invention

The present invention relates to antennas, and more particularly, to a dual band antenna for mobile communications.

2. Description of the Related Art

With the rapid progress of mobile communications, the capacity of existing systems is becoming saturated, and thus, new systems are being developed at new frequencies to enhance capacity. Accordingly, the interrelationship between existing and new systems must be taken into consideration in the design of mobile communications equipment. For mobile communications antennas, major design concerns are power efficiency and effective use of frequency.

In practice, it is desirable in the Republic of Korea (South Korea) to interlink the existing CDMA (Code Division Multiple Access) system with the new PCS (Personal Communication System) system, in the U.S.A. to interlink the existing AMPS (Advanced Mobile Phone Service) system with the PCS system, and in Europe to interlink the existing GSM (Groupe Speciale Mobile) system with the DCS (Digital Communication System) 1800 system. Generally, a "dual band system" is a system that allows for communications within two different systems at different frequency bands, such as in above examples. It is desirable to manufacture communications equipment capable of operating within dual band systems.

Heretofore, each radio telephone terminal in the dual band systems are provided with two separate miniature antennas for two different bands, which results in increased production cost. Also, the use of two antennas for this purpose is an obstacle to the miniaturization of the radio telephone terminal, and results in an inconvenience to the user. For these reasons, it is required to develop a dual band antenna capable of being used for both bands.

U.S. Pat. No. 4,509,056 discloses a multi-frequency antenna employing a tuned sleeve choke. Referring to FIG. 1, an antenna of the type disclosed in that patent is shown. This antenna operates effectively in a system in which the frequency ratio between operating frequencies is 1.25 or higher. The internal conductor 10 connected to coaxial feed line 2 and the sleeve choke 12*i* act as a radiating element. The feed point of sleeve choke 12*i* is short-circuited and the other end thereof is open. The lengths of conductor 10 and sleeve choke 12*i* are designed so as to achieve maximum efficiency at a desired frequency.

The choke 12*i* is partially filled with dielectric material 16*i* that is dimensioned so that the choke forms a quarter wavelength transmission line and prevents coupling between the shell 14*i* and the extension 10 at the open end of the choke at the highest frequency. At some lower frequency of operation, the choke 12*i* becomes ineffective as an isolation element and the entire length P of the structure from the ground plane to the end of the conductor, becomes a monopole antenna at the lower resonant frequency.

The coupling between conductor 10 and sleeve choke 12*i* occurs at the open end of sleeve choke 12*i*. That is, when the length $$l = \frac{\lambda}{4},$$

the choke acts as a high impedance, whereby the coupling between conductor 10 and sleeve choke 12*i* is minimal. When $$\frac{\lambda}{4} \neq l,$$

the choke acts as a low impedance, whereby the coupling between conductor 10 and choke 12*i* is higher. The electrical length of choke 12*i* can be adjusted by varying the dielectric constant of dielectric material 16*i*.

The construction consisting of internal and external conductors 10, 14*i* is regarded as coaxial transmission line, and its characteristic impedance is expressed as follows:

$$Z_c = 59.95 / \sqrt{\varepsilon_r} \ln(D/d) \tag{1}$$

where $\epsilon_r$ is dielectric constant, D is the diameter of the external conductor, and d is the diameter of the internal conductor. The input impedance between internal and external conductors 10, 14*i* is denoted by the following equation:

$$Zin = Z_c \frac{Z_L + jZ_c \tanh\gamma \cdot l}{Z_c + jZ_L \tanh\gamma \cdot l} \tag{2}$$

where $\gamma=\alpha+j\beta$, $\alpha$ is attenuation factor, $\beta$ is propagation constant, l is length of transmission line, and $Z_L$ is load impedance.

In the antenna of FIG. 1, the ground plate 20 and external conductor 14*i* are structurally adjacent to each other, thereby causing parasitic capacitance which degrades the antenna efficiency. To improve the antenna efficiency, the parasitic capacitance can be decreased. Accordingly, in the construction of FIG. 1, the diameter of external conductor 14*i* must be reduced for this purpose, which is ultimately the same as the reduction of characteristic impedance of choke 12*i* according to the above equation (1). That is, such reduction in the characteristic impedance of choke 12*i* gives rise to a change in the amount of coupling, resulting in a degradation of the antenna's performance.

Thus, to minimally affect the amount of coupling and to keep the characteristic impedance of choke 12*i* essentially the same as it was previously (i.e., before the diameter of conductor 14*i* changed), the diameter of internal conductor 10 must be reduced. This results in a reduction in the antenna's bandwidth. Therefore, when the antenna is manufactured in such a manner, the same cannot satisfactorily cover the frequency bandwidth required for the system.

Further, since the dielectric material is employed to adjust the quantity of coupling, the dielectric constant and the dimension of the dielectric material must be accurately selected for proper coupling.

SUMMARY OF THE INVENTION

It is an object of the present invention to provide a dual band antenna with improved performance and bandwidth, by minimizing parasitic capacitance between ground and an external conductor thereof.

It is another object of the present invention to provide a dual band antenna which has a simple and compact structure and high performance.

It is still another object of the present invention to provide a dual band antenna which is inexpensive and convenient to use.

In an exemplary embodiment of the present invention, a dual band antenna includes an inductor, first and second rod-like radiating elements connected to opposite ends of the inductor, and dielectric material surrounding both the inductor and the joining portions of the first and second radiating elements on the respective ends of the inductor. A conductive support housing, e.g., a cylindrical metal housing, surrounds the dielectric and supports the inductor and the joining portions of the first and second radiating elements. The housing and dielectric create a capacitance, such that an LC resonant circuit is formed in conjunction with the inductor. The LC circuit is designed so that only one radiating element radiates at the higher band of the dual operating band, whereas both radiating elements radiate at the lower band.

DETAILED DESCRIPTION OF THE PREFERRED EMBODIMENT

Figure 1:
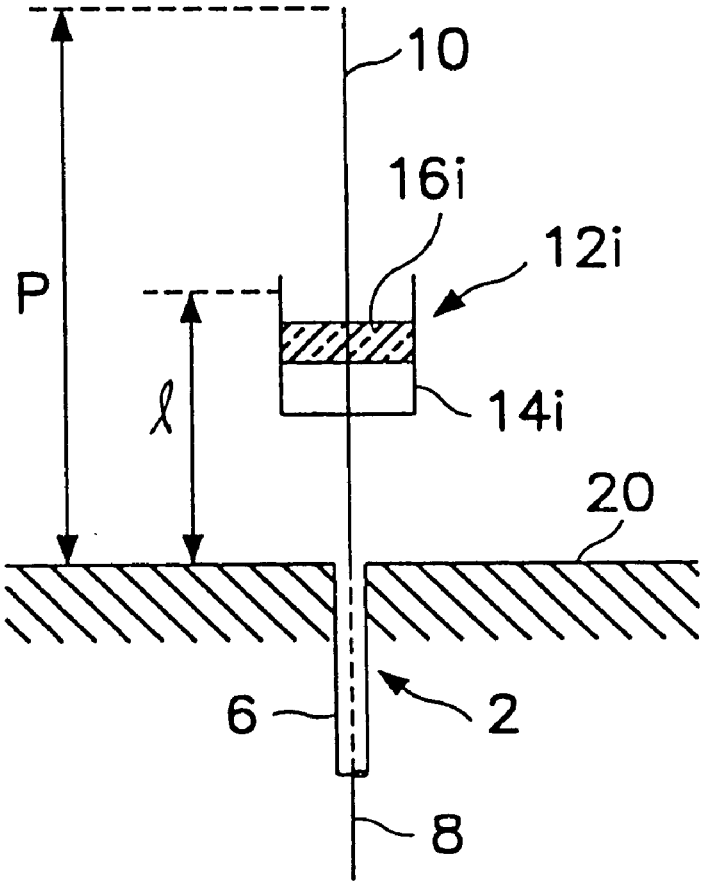
FIG. 1 (PRIOR ART)
FIG. 1 is a sectional view of a monopole antenna operating at dual frequencies according to a conventional embodiment of a multi-frequency antenna employing tuned sleeve chokes.

The present invention will now be described more specifically with reference to the drawings attached only by way of example. It is to be noted that like reference numerals and characters used in the accompanying drawings refer to like constituent elements.

Figure 2:
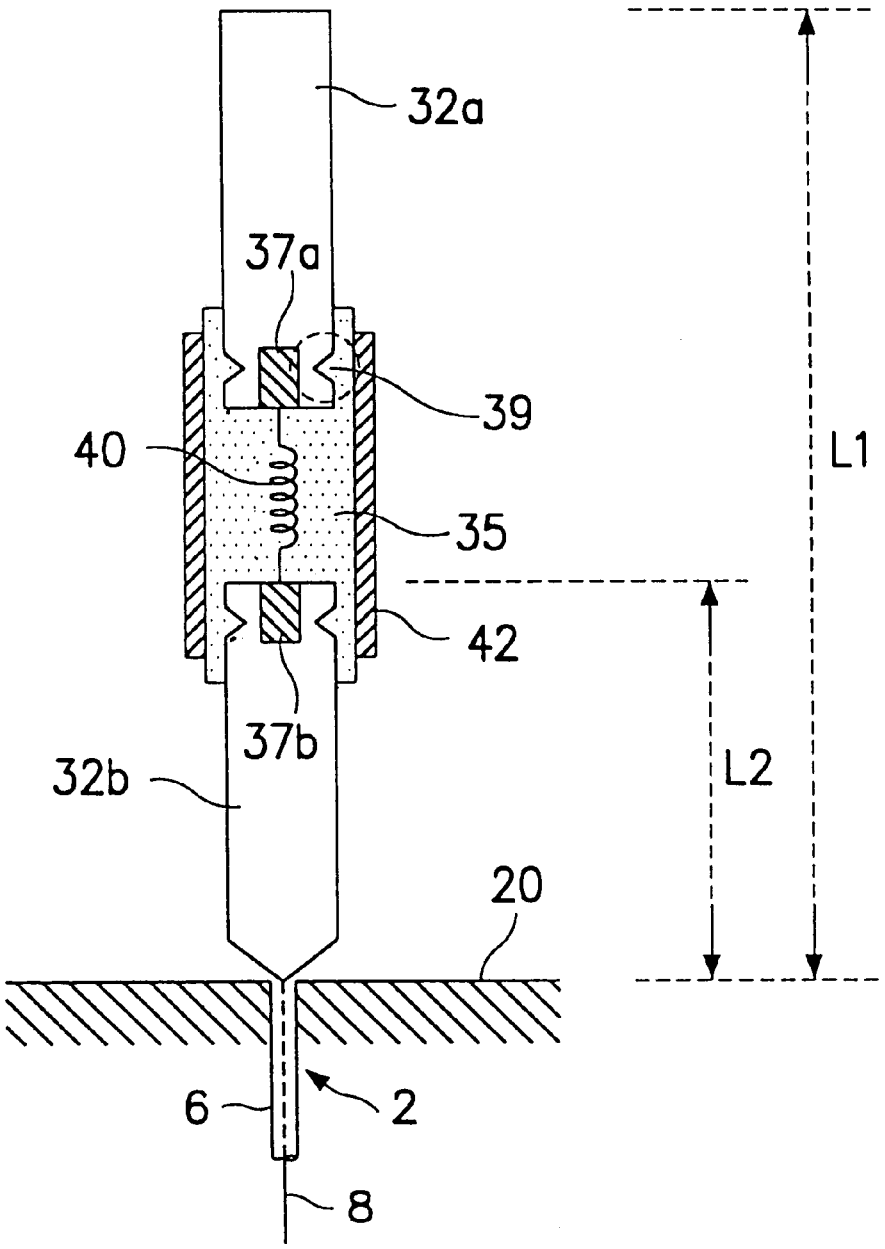
FIG. 2 is a sectional view illustrating the construction of a dual band antenna according to an embodiment of the present invention.

Referring to FIG. 2, a cross section of an exemplary dual band antenna in accordance with the invention is shown. The antenna includes an inductor 40, first and second rod-shaped radiating elements 32*a*, 32*b*, each connected to the respective ends of inductor 40, with dielectric material 35 surrounding the entire inductor and the joined portions of first and second radiating elements 32*a*, 32*b* on the respective ends connected to the inductor 40. A conductive cylindrical support housing 42, e.g., a cylindrical metal housing, fixes inductor 40 in place and supports the same, as well as supporting the related joint portions of first and second radiating elements 32*a*, 32*b*. Support housing 42 and dielectric 35 together form a capacitive structure, whereby an LC resonant circuit is created in conjunction with inductor 40.

First and second radiating elements 32*a*, 32*b* are each provided with grooves 39 which are filled with dielectric material 35. A bearing structure of the radiating elements 32*a*, 32*b* is thereby formed, since a uniform horizontal force is applied from the cylindrical metal housing 42 to the dielectric material 35. The other end of the second radiating element 32*b* is connected to internal conductor 8 of coaxial feed line 2. The outer conductor 6 of coaxial line 2 is connected to ground plate 20. The reference numerals 37*a* and 37*b* indicate the joint portions between inductor 40 and first and second radiating elements 32*a*, 32*b*. For example, these joints can be solder connections.

Figure 3:
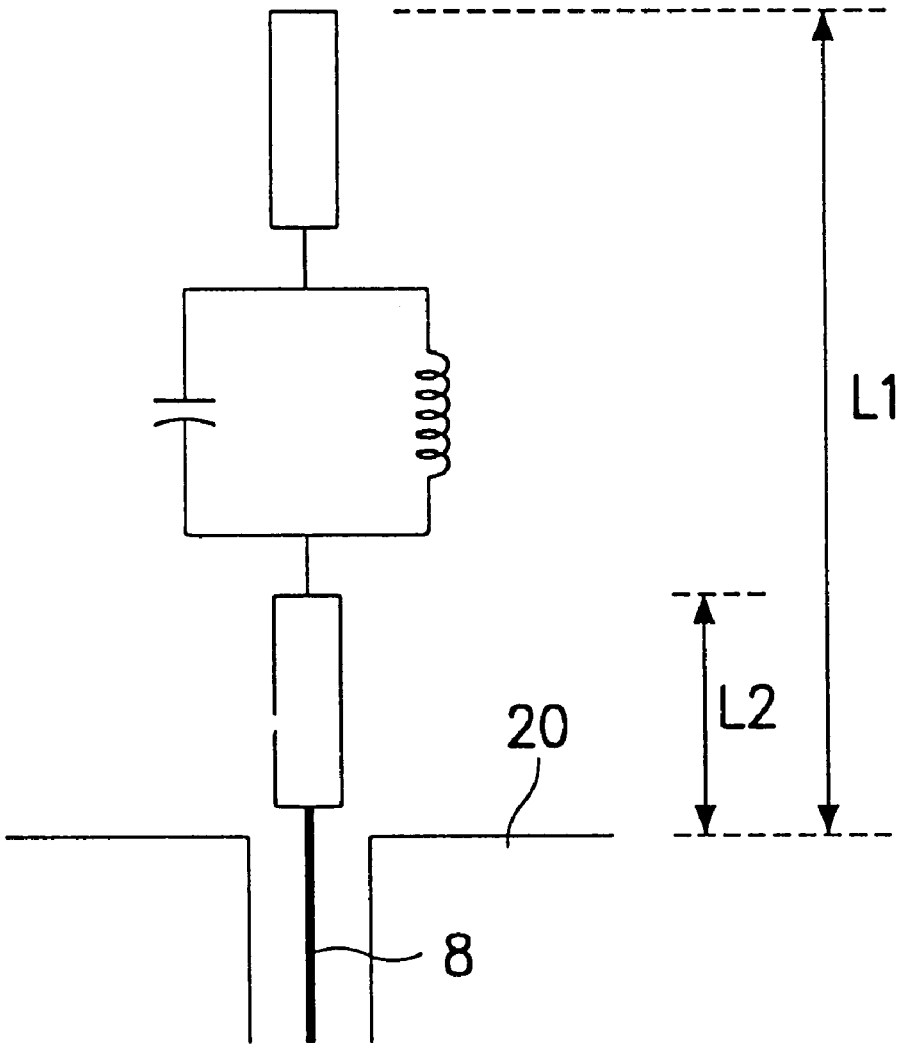
FIG. 3 is a circuit diagram illustrating the equivalent circuit of the antenna shown in FIGS. 1 and 2.

FIG. 3 shows a circuit diagram illustrating a lumped element equivalent circuit for the antenna of FIG. 1 or 2. In the equivalent circuit, the coupling between first and second radiating elements 32*a*, 32*b* is denoted by capacity C and inductor L.

Referring collectively to FIGS. 2 and 3, in the embodiment of the present invention, the amount of coupling between the first and second radiating elements 32*a*, 32*b* can be controlled via inductor 40, dielectric material 35, and cylindrical metal housing 42. The overall length of the antenna is determined on the basis of first and second radiating elements 32*a*, 32*b*, inductor 40, and the operating frequency band. More specifically, the overall antenna length L1 is determined as a function of wavelength in the lower operating frequency band. In the lower frequency band, both the first and second radiating elements 32*a*, 32*b* radiate electromagnetic energy. The physical length L1 is preferably selected such that the electrical length of the overall antenna encompassing L1 is, e.g., $\lambda/4$ or $5\lambda/8$ at the center frequency of the lower frequency band.

For the higher frequency band, due to the resonance of the LC resonant circuit, only the lower radiating element 32*b* radiates. Consequently, the length L2 of radiating element 32*b* is preferably selected such that the electrical length of element 32*b* is, e.g., $\lambda/4$ or $5\lambda/8$ at the center frequency of the higher frequency band. By way of example, the lower frequency band can be intended for the range of about 824 MHz–894 MHz, and the higher frequency band can be intended for the range of about 1,750 MHz–1,870 MHz.

The inductor 40, dielectric material 35, and cylindrical metal housing 42, connected as shown in FIG. 2 to form the LC resonant circuit of FIG. 3, are designed to produce resonance within the higher frequency band to thereby provide a high impedance. Consequently, in the higher frequency band, coupling between first and second radiating elements 32*a*, 32*b* does not occur, and only the lower radiating element 32*b* radiates. In the lower frequency band, the design of inductor 40, dielectric 35 and housing 42 is such that the LC resonant circuit assumes a relatively lower impedance value, and accordingly, the second radiating element 32*b* is coupled with the first radiating element 32*a*, thereby being electrically connected to each other to form a low frequency antenna.

Figure 4:
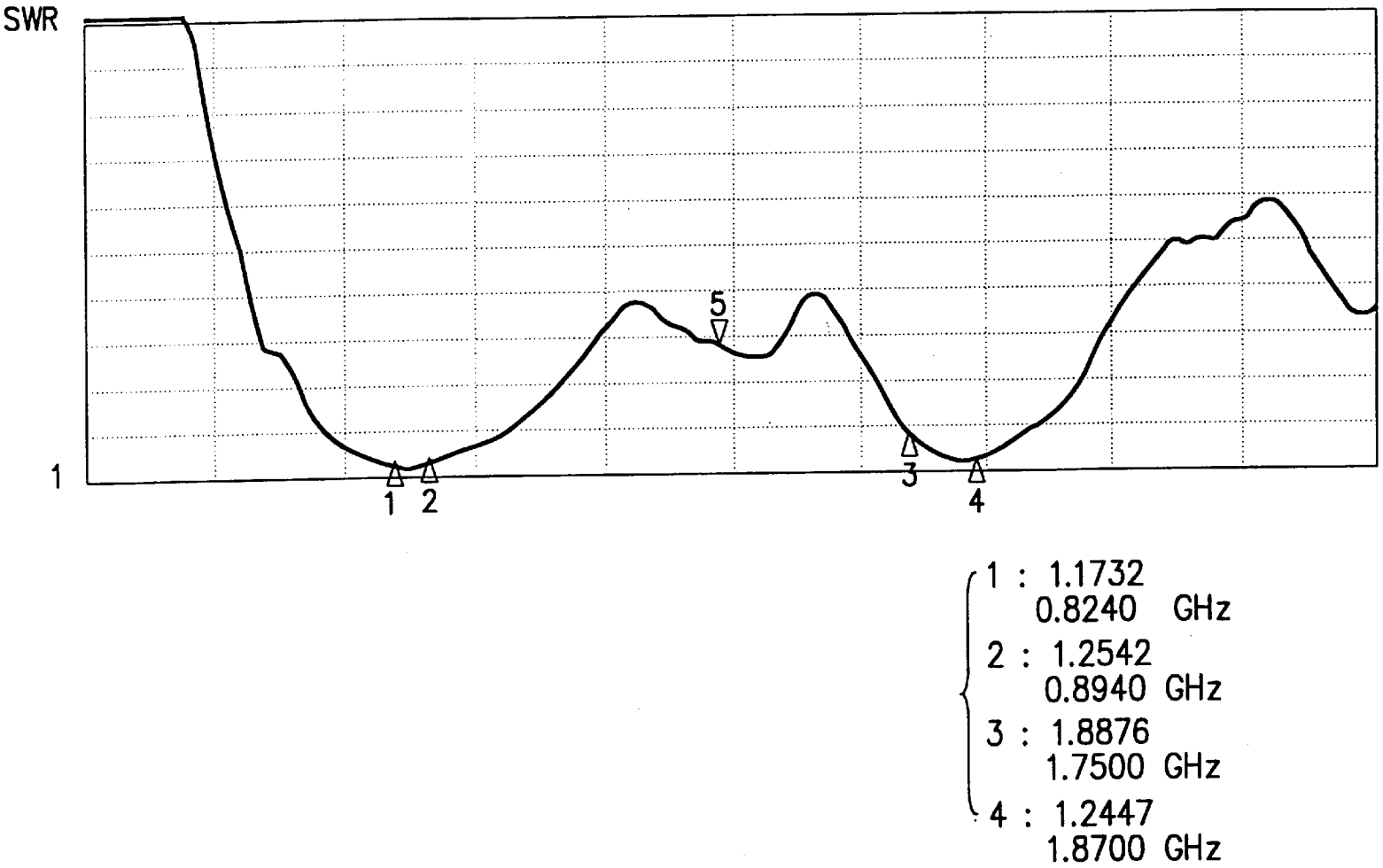
FIG. 4 is a graph illustrating standing wave ratio (SWR) of an experimental dual band antenna in accordance with an embodiment of the invention.

FIG. 4 is a graph illustrating standing wave ratio (SWR) of an exemplary dual band antenna in accordance with the present disclosure. The graph represents experimental values obtained from hand-held telephone terminals (Model No. SCH-100) of the CDMA system manufactured by Samsung Electronics Co. Ltd. At experimental point $\Delta 1$, the standing wave ratio is 1.1732 at 0.8240 GHz. At experimental point $\Delta 2$, the standing wave ratio is 1.2542 at 0.8940 GHz. As such, it is readily apparent that embodiments of the present invention can achieve good SWR performance over the range of 849 MHz–894 MHz for transmitting/receiving in a CDMA system.

Figure 5:
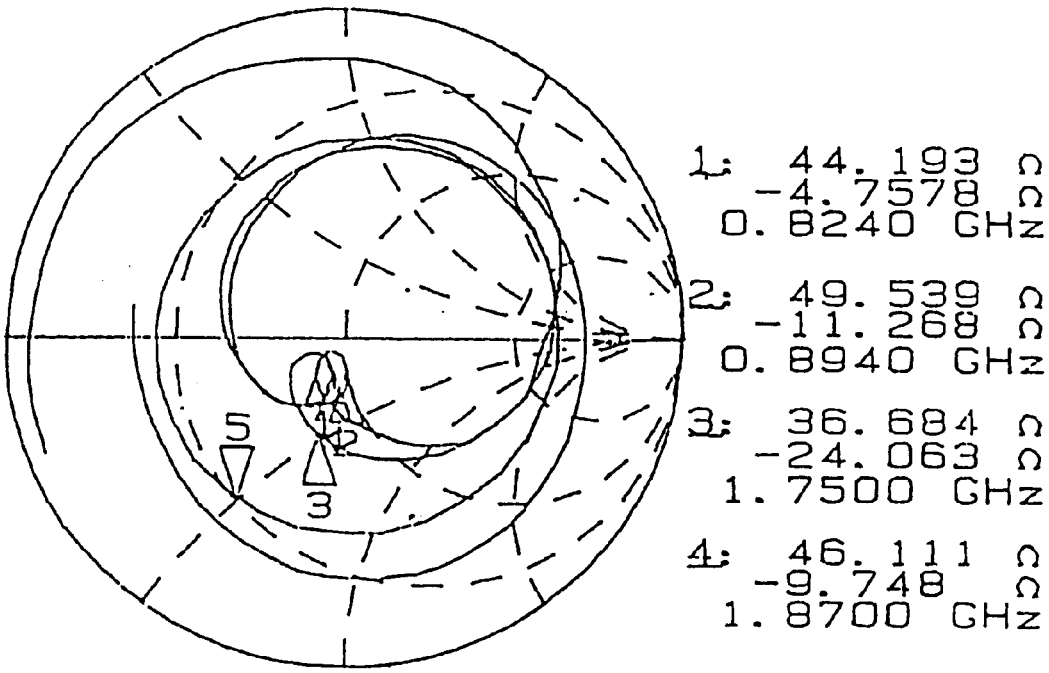
FIG. 5 is a Smith chart illustrating measured results for a dual band antenna in accordance with an embodiment of the invention.

FIG. 5 is a Smith chart illustrating measured input impedance for an experimental dual band antenna fabricated according to an embodiment of the present invention.

Although the principles of the present invention have been explained in detail with reference to a specific embodiment thereof, it must be in no way construed as a limitation of the invention itself, and it will be apparent that many changes and modifications may be made thereto without departing from the spirit of the present invention. The appended claims cover all such changes and modifications which fall within the true spirit and scope of the present invention.

As described above, the above inventive antenna can be applied to dual band systems such as GSM/DECT, GSM/DCS1800, AMPS or CDMA (824 MHz–894 MHz)/PCS systems. Further, if the frequency separation between the two desired operating bands is not an integer multiple of ¼ wavelength, an antenna in accordance with the invention can nevertheless be easily manufactured by changing the inductance of the inductor and/or dimensions or constants of the dielectric material. Also, for the relatively longer antenna length of 5λ/8 mentioned above, the radiation pattern of the antenna is still isotropic in azimuth, while the antenna gain increases. Therefore, the above inventive antenna can be advantageously applied to mobile communication systems such as vehicle mounted mobile telephones. In addition, the present invention is advantageous in that the parasitic capacitance between ground and the external conductor can be minimized so as to improve the antenna performance. Moreover, the construction allows for a reduction in weight and antenna size.

What is claimed is:

1. A dual band antenna comprising:

an inductor;

first and second rod-shaped radiating elements connected to opposite ends of said inductor;

dielectric material surrounding: said inductor, a portion of said first radiating element connected to one end of said inductor, and a portion of said second radiating element connected to the other end of said inductor;

a conductive housing surrounding said dielectric material and supporting said inductor together with joined portions of said first and second radiating elements, thereby forming capacitance together with said dielectric material; and a bearing structure formed by said first and second radiating elements, said dielectric material, and said conductive housing, wherein said first and second radiating elements are provided with grooves that are filled with said dielectric material being surrounded by said conductive housing, thereby forming said bearing structure.

2. The antenna of claim 1 wherein said conductive housing comprises a cylindrical metal housing.

3. The antenna of claim 1 wherein the other end of said second radiating element is connected to an internal conductor of a coaxial feed line having an outer conductor connected to a ground plate.

4. The antenna of claim 1 wherein the other end of said second radiating element is connected to an internal conductor of a coaxial feed line having an outer conductor connected to a ground plate.

5. The antenna of claim 1 wherein said conductive housing and said dielectric material form a capacitance, said inductor and said capacitance forming an LC resonant circuit that provides a high impedance within a high frequency band of the dual band and a low impedance within a low frequency band of the dual band, whereby only one of said radiating elements radiates within the high frequency band and both of said radiating elements radiate within the low frequency band.

6. The antenna of claim 5 wherein the low frequency band is a standard CDMA band and the high frequency band is a standard PCS band.

7. The antenna of claim 1 wherein said opposite ends of said inductor are each soldered to a respective said joined portion of said first or second radiating element.

8. A dual band antenna comprising:

an inductor;

first and second rod-shaped radiating elements connected to first and second ends, respectively, of said inductor;

dielectric material surrounding: a portion of said first radiating element connected to one end of said inductor, said entire inductor, and a portion of said second radiating element connected to the other end of said inductor;

a conductive support member for fixing said inductor in place and supporting said inductor and the related portions of said first and second radiating elements together with said dielectric material, thereby forming capacitance with said dielectric material, such that an LC resonant circuit is formed; and a bearing structure formed by said first and second radiating elements, said dielectric material, and said conductive support member, wherein said first and second radiating elements are provided with grooves that are filled with said dielectric material being surrounded by said conductive support member, thereby applying a uniform horizontal force from said conductive support member to said dielectric material and forming said bearing structure.

9. The antenna of claim 8 wherein said antenna operates in a specified frequency band as an antenna having a length as long as said second radiating element, and in a relatively lower frequency band as an antenna having a length combining both of said first and second radiating elements.

10. The antenna of claim 8 wherein said antenna operates in a specified frequency band as an antenna having a length as long as said second radiating element, and in a relatively lower frequency band as an antenna having a length combining both of said first and second radiating elements.

11. The antenna of claim 10 wherein said lower frequency band is a range of 824 MHz–894 MHz, and said relatively higher frequency band is a range of 1,750 MHz–1,870 MHz.

12. The antenna of claim 10 wherein said antenna has a length of ¼ wavelength at a center frequency of the corresponding frequency band.

13. The antenna of claim 10 wherein the other end of said second radiating element is connected to an internal conductor of a coaxial feed line having an outer conductor connected to a ground plate.

14. The antenna of claim 10 wherein said antenna has a length of ⅝ wavelength at a center frequency of the corresponding frequency band.

15. The antenna of claim 14 wherein said lower frequency band is a range of 824 MHz–894 MHz, and said relatively higher frequency band is a range of 1,750 MHz–1,870 MHz.

* * * * *